US009028294B2

(12) United States Patent
Moon et al.

(10) Patent No.: US 9,028,294 B2
(45) Date of Patent: May 12, 2015

(54) APPARATUS AND METHOD FOR MONITORING GLASS PLATE POLISHING STATE

(75) Inventors: Won-Jae Moon, Seoul (KR); Hyung-Young Oh, Goyang-si (KR); Dae-Yeon Lee, Chungbuk (KR); Jae-Ik Song, Cheongju-si (KR); Young-Kuk Kim, Paju-si (KR); Kyu-Chul Chung, Chungbuk (KR); Hyun-Chul Chung, Cheongju-si (KR)

(73) Assignee: LG Chem, Ltd., Seoul (KR)

( * ) Notice: Subject to any disclaimer, the term of this patent is extended or adjusted under 35 U.S.C. 154(b) by 713 days.

(21) Appl. No.: 13/045,273

(22) Filed: Mar. 10, 2011

(65) Prior Publication Data

US 2011/0223834 A1 Sep. 15, 2011

(30) Foreign Application Priority Data

Mar. 11, 2010 (KR) ..... 10-2010-0021658

(51) Int. Cl.

| | |
|---|---|
| ***B24B 49/00*** | (2012.01) |
| ***B24B 49/10*** | (2006.01) |
| ***B24B 7/24*** | (2006.01) |
| ***B24B 13/015*** | (2006.01) |

(52) U.S. Cl.

CPC . *B24B 49/10* (2013.01); *B24B 7/24* (2013.01); *B24B 13/015* (2013.01)

(58) Field of Classification Search

CPC ..... B24B 49/10; B24B 7/24; B24B 13/015; B24B 9/102; B24B 49/16; B24B 9/017; G05B 19/4207; G05B 9/017; G05B 2219/31407; G05B 2219/45199; G05B 2219/49311; G05B 2219/50353; G01N 21/896

USPC ..... 451/4, 6, 8, 41, 44

See application file for complete search history.

(56) References Cited

U.S. PATENT DOCUMENTS

| | | | | | |
|---|---|---|---|---|---|
| 3,735,534 | A | * | 5/1973 | Mayo | 451/162 |
| 3,769,762 | A | * | 11/1973 | Mayo | 451/42 |
| 4,306,808 | A | * | 12/1981 | Vander Neut | 356/239.1 |
| 4,375,141 | A | * | 3/1983 | Gaetano | 451/65 |
| 4,437,268 | A | * | 3/1984 | Righetti | 451/58 |
| 4,484,413 | A | * | 11/1984 | Yamamoto et al. | 451/5 |
| 4,525,958 | A | * | 7/1985 | Reissig | 451/26 |

(Continued)

FOREIGN PATENT DOCUMENTS

| | | | |
|---|---|---|---|
| JP | 08099265 | A | 4/1996 |
| JP | 2001-138218 | A | 5/2001 |

(Continued)

*Primary Examiner* — Maurina Rachuba

(74) *Attorney, Agent, or Firm* — McKenna Long & Aldridge LLP

(57) ABSTRACT

Disclosed are an apparatus and a method for monitoring a glass plate polishing state. The apparatus may include a location measuring unit for measuring a location on a glass plate being polished by a polishing machine, a current measuring unit for measuring an electric current flowing into the polishing machine, a memory unit for storing a reference value of the electric current flowing into the polishing machine for each polishing location of the glass plate, and a control unit for determining whether a polishing state is faulty, by comparing a value of the electric current measured by the current measuring unit for each polishing location measured by the location measuring unit with a corresponding reference value of the electric current stored in the memory unit for each polishing location.

25 Claims, 6 Drawing Sheets

(56) References Cited

U.S. PATENT DOCUMENTS

| | | | | |
|---|---|---|---|---|
| 4,658,550 | A * | 4/1987 | Myers et al. | 451/5 |
| 4,662,120 | A * | 5/1987 | Imai et al. | 451/239 |
| 4,662,122 | A * | 5/1987 | Ohmura et al. | 451/5 |
| 4,739,590 | A * | 4/1988 | Myers et al. | 451/44 |
| 4,902,951 | A * | 2/1990 | Ohta et al. | 700/164 |
| 4,947,015 | A * | 8/1990 | Lach | 451/21 |
| 5,157,878 | A * | 10/1992 | Hiyoshi et al. | 451/5 |
| 5,613,894 | A * | 3/1997 | Delle Vedove | 451/1 |
| 6,503,361 | B1 | 1/2003 | Nyui et al. | |
| 7,235,002 | B1 * | 6/2007 | Pride | 451/43 |
| 2008/0146119 | A1 | 6/2008 | Sasaki et al. | |

FOREIGN PATENT DOCUMENTS

| | | | |
|---|---|---|---|
| JP | 2004-330362 | A | 11/2004 |
| JP | 200534992 | A | 2/2005 |
| JP | 2008528300 | A | 7/2008 |
| JP | 2009-028805 | | 2/2009 |

* cited by examiner

| | ···· | V6 | V7 | V8 | ···· |
|---|---|---|---|---|---|
| ⋮ | | ⋮ | ⋮ | ⋮ | |
| H3 | ···· | 45~60 [A] | 58~75 [A] | 70~85 [A] | ···· |
| H4 | ···· | 43~55 [A] | 50~67 [A] | 65~80 [A] | ···· |
| H5 | ···· | 45~60 [A] | 53~70 [A] | 64~80 [A] | ···· |
| ⋮ | | ⋮ | ⋮ | ⋮ | |

FIG. 7

| .... | p1 | p2 | p3 | p4 | .... |
|---|---|---|---|---|---|
| .... | 65~77 [A] | 60~72 [A] | 55~65 [A] | 48~62 [A] | .... |

FIG. 8

| .... | r1 | r2 | r3 | r4 | .... |
|---|---|---|---|---|---|
| .... | 40~52 [A] | 47~61 [A] | 56~70 [A] | 60~73 [A] | .... |

APPARATUS AND METHOD FOR MONITORING GLASS PLATE POLISHING STATE

CROSS-REFERENCE TO RELATED APPLICATION

This application claims priority under 35 USC 119(a) to Korean Patent Application No. 10-2010-0021658 filed in Republic of Korea on Mar. 11, 2010, the entire contents of which are incorporated herein by reference.

BACKGROUND OF THE INVENTION

1. Field of the Invention

The present invention relates to an apparatus and a method for monitoring a glass plate polishing state and a polishing machine comprising the same, and more particularly, to an apparatus and a method for monitoring a glass plate polishing state, which may determine a fault in a polishing state during glass plate polishing using a polishing machine and may provide corresponding information, and a polishing machine comprising the same.

2. Description of the Related Art

Generally, it is very important that a glass (or a glass plate) applied to a liquid crystal display keeps its flatness to a certain level so as to accurately realize images on the liquid crystal display. Accordingly, fine waviness or unevenness on the surface of the glass should be removed through polishing.

A conventional glass plate polishing apparatus includes an upper unit (or an upper plate) having a polishing pad and a lower unit (or a lower plate) where a glass plate will be put, wherein the polishing pad of the upper unit is contacted with the glass plate on the lower unit and the lower unit is rotated while a polishing solution is supplied to the upper unit by free fall, so that the glass plate is polished with the polishing pad. Alternatively, the glass plate polishing apparatus may include an upper unit where a glass plate will be fixed and a lower unit having a polishing pad, wherein the glass plate may be polished with the polishing pad while a polishing solution is supplied to the glass plate.

However, glass plate polishing using the conventional polishing apparatus has difficulty in recognizing a polishing state during polishing. For example, it is difficult to accurately recognize whether a defect such as an impurity or a scratch exists on a glass plate being polished, and where the defect exists on the glass plate, if any. Also, it is difficult to clearly recognize whether an amount of a polishing solution supplied during polishing is large or small, whether a proper polishing pressure is being applied, how much a polishing pad is worn down, and the like. In addition, it is difficult to recognize whether a glass plate in a polishing apparatus is damaged, and where the damaged portion exists on the glass plate, if any.

In particular, with the trend toward mass production and larger size of glass plates, it is more difficult to individually monitor a polishing state for each glass plate.

If a glass plate polishing state is poorly monitored during polishing, the polishing efficiency of the glass plate is reduced and an operator cannot take a proper action when a fault occurs. For example, when a defect such as an impurity or a scratch is not removed but polishing is terminated after the lapse of a preset polishing time, the polishing effect is not obtained. Conversely, when polishing continues up to a preset time even after a defect is removed, the polishing efficiency is reduced and the time and cost is wasted. Moreover, a neglected defect at a specific location of a glass plate due to poor monitoring will affect the subsequent manufacturing process of the glass plate. Also, when a supply amount of a polishing solution is too large, a polishing pad will not have a friction force, and when a supply amount of a polishing solution is too small, the usage effect of the polishing solution will not be obtained. Accordingly, when a polishing solution is not supplied at a proper amount, the polishing efficiency obtained by the polishing solution is not achieved. Also, when the wear of a polishing pad is not monitored, it is difficult to accurately recognize a replacement recycle of the polishing pad. In addition, when it is not monitored whether a polishing pressure of a polishing apparatus is proper, or whether a glass plate is damaged, a polishing state is recognized only after seeing a polished glass plate, resulting in waste of time and cost.

SUMMARY OF THE INVENTION

The present invention is designed to solve the above-described problems, and therefore, it is an object of the present invention to provide an apparatus and a method for quickly and accurately monitoring a glass plate polishing state during polishing.

Additional features and advantages of the invention will be set forth in the description which follows, and in part will be obvious from the description, or may be learned by practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth herein.

To achieve the object, an apparatus for monitoring a glass plate polishing state according to the present invention may include a location measuring unit for measuring a location on a glass plate being polished by a polishing machine, a current measuring unit for measuring an electric current flowing into the polishing machine, a memory unit for storing a reference value of the electric current flowing into the polishing machine for each polishing location of the glass plate, and a control unit for determining whether a polishing state is faulty by comparing a value of the electric current measured by the current measuring unit for each polishing location measured by the location measuring unit with a corresponding reference value of the electric current stored in the memory unit for each polishing location.

To achieve the object, a polishing machine for a glass plate according to the present invention may include the above-described apparatus for monitoring a glass plate polishing state.

To achieve the object, a method for monitoring a glass plate polishing state according to the present invention may include (S1) storing a reference value of an electric current flowing into a polishing machine for each polishing location of a glass plate, (S2) measuring a location on the glass plate being polished by the polishing machine, (S3) measuring the electric current flowing into the polishing machine, and (S4) determining whether a polishing state is faulty by comparing a measured value of the electric current for each polishing location with a corresponding reference value of the electric current for each polishing location.

According to the present invention, it may quickly and accurately monitor a glass plate polishing state during glass plate polishing using a polishing machine. Accordingly, it may enable an operator to take a proper action in improving the polishing efficiency depending on the polishing state monitored as described above.

In particular, accordingly to an embodiment of the present invention, it may recognize an accurate location on a glass plate under a faulty polishing state and may provide information about the corresponding location. Accordingly, it may adjust a polishing location based on the information and perform a polishing process on a part of the glass plate needed for further polishing. Also, when a defect such as an impurity or a scratch continuously occurs at a specific location on the glass plate, it may enable an operator to recognize the defective part and to inspect a fault in a glass plate manufacturing process. Accordingly, it may fundamentally solve the problem causing a reduction in the polishing efficiency of the glass plate.

According to another embodiment of the present invention, it may recognize whether a supply amount of a polishing solution is proper, during polishing. Accordingly, when a supply amount of a polishing solution is excessive or insufficient, it may suitably reduce or increase the supply amount of the polishing solution, thereby optimizing the polishing efficiency by the polishing solution.

According to still another embodiment of the present invention, it may provide information about the time needed to polish a glass plate. For example, when a fault still exists after the lapse of a preset polishing time, it may increase the polishing time more than a scheduled time, and when a fault does not exist although a preset polishing time is not reached, it may reduce the polishing time. Accordingly, it may prevent waste of unnecessary time and cost while improving the polishing efficiency in a glass plate polishing process.

According to other embodiments of the present invention, it may accurately recognize how much a polishing pad mounted in a polishing machine is worn down, so that the polishing pad may be replaced at a proper time. Also, it may recognize whether a polishing pressure of the polishing machine is proper, so that the polishing pressure may be adjusted to a proper level when the polishing pressure is not proper. Also, it may recognize whether a glass plate in the polishing machine is damaged, so that it may enable an operator to take an efficient action on the glass plate, for example, not to polish a severely damaged glass plate.

BRIEF DESCRIPTION OF THE DRAWINGS

Other objects and aspects of the present invention will become apparent from the following description of embodiments with reference to the accompanying drawing in which:

FIG. 7 is a table illustrating a portion of reference values of an electric current flowing into a polishing machine, stored in a memory unit according to another embodiment of the present invention;

FIG. 8 is a table illustrating a portion of reference values of an electric current flowing into a polishing machine, stored in a memory unit according to still another embodiment of the present invention.

DESCRIPTION OF THE PREFERRED EMBODIMENT

Hereinafter, the present invention will be described in detail. Prior to the description, it should be understood that the terms used in the specification and the appended claims should not be construed as limited to general and dictionary meanings, but interpreted based on the meanings and concepts corresponding to technical aspects of the present invention on the basis of the principle that the inventor is allowed to define terms appropriately for the best explanation.

Therefore, the description proposed herein is just a preferable example for the purpose of illustrations only, not intended to limit the scope of the invention, so it should be understood that other equivalents and modifications could be made thereto without departing from the spirit and scope of the invention.

Figure 1:
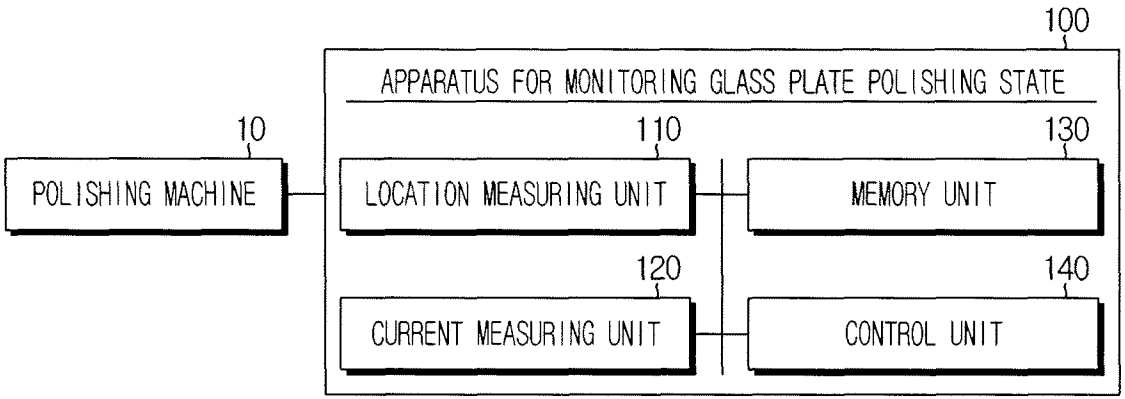
FIG. 1 is a schematic block diagram illustrating a functional structure of an apparatus for monitoring a glass plate polishing state according to an embodiment of the present invention.
Figure 2:
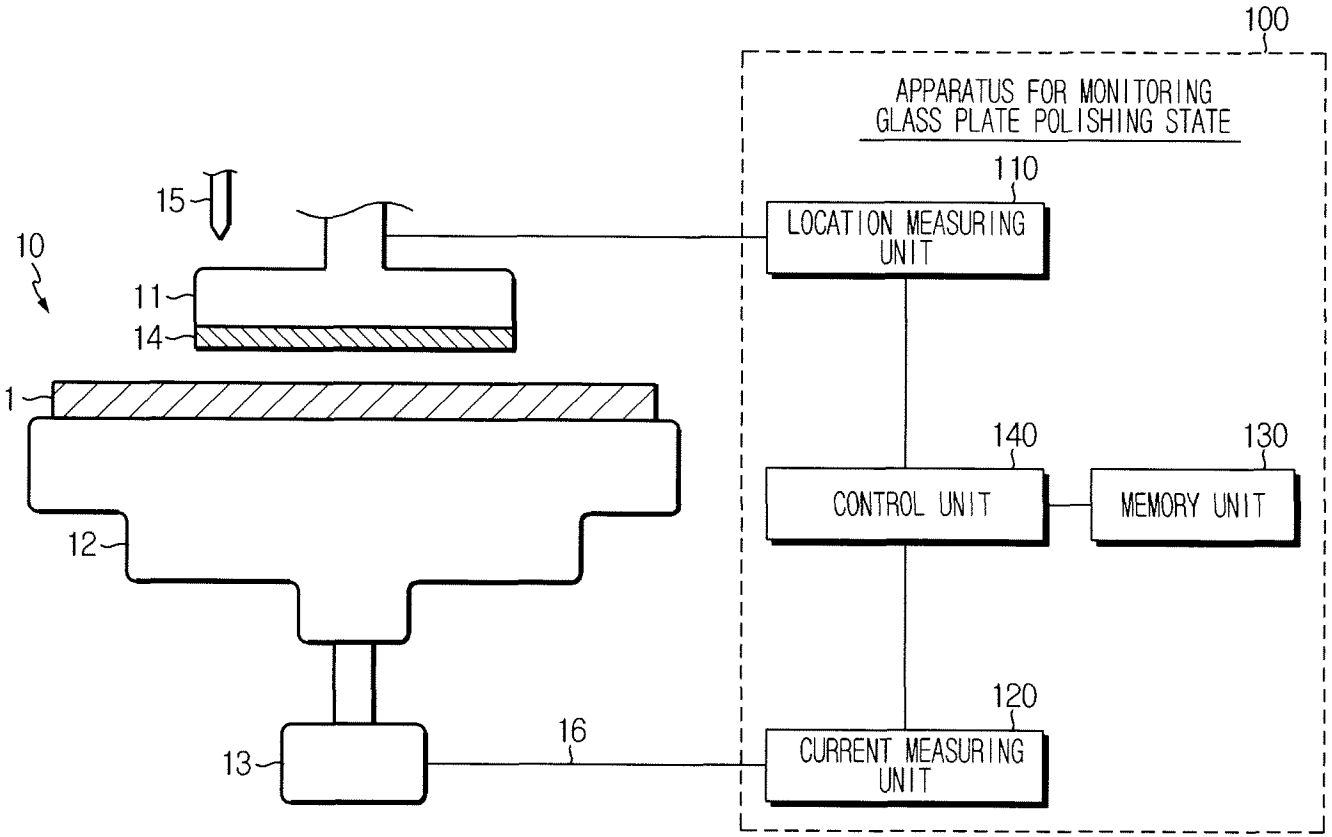
FIG. 2 is a view illustrating an example of an apparatus for monitoring a glass plate polishing state mated with the components of a polishing machine according to an embodiment of the present invention.

FIG. 1 is a schematic block diagram illustrating a functional structure of an apparatus 100 for monitoring a glass plate polishing state according to an embodiment of the present invention. FIG. 2 is a view illustrating an example of the apparatus 100 for monitoring a glass plate polishing state mated with the components of a polishing machine 10 according to an embodiment of the present invention.

Referring to FIGS. 1 and 2, the apparatus 100 for monitoring a glass plate polishing state according to an embodiment of the present invention may include a location measuring unit 110, a current measuring unit 120, a memory unit 130, and a control unit 140.

The location measuring unit 110 may measure a location on a glass plate 1 being polished by the polishing machine 10. The polishing machine 10 may include an upper unit 11 having a polishing pad 14 attached thereto for polishing the glass plate 1, and a lower unit 12 where the glass plate 1 to be polished is mounted, as shown in FIG. 2. The lower unit 12 of the polishing machine 10 may rotate the glass plate 1, and the upper unit 11 may enable the front surface of the glass plate 1 to be polished by the polishing pad 14 while moving horizontally.

In particular, the location measuring unit 110 may be connected to the upper unit 11, and may measure a location on the glass plate 1 being polished, that is, a polishing location, by sensing the movement of the upper unit 11, as shown in FIG. 2. However, the present invention is not limited in this regard, and the location measuring unit 110 may be provided in various configurations. For example, the location measuring unit 110 may measure a polishing location by sensing a location of the upper unit 11 through an infrared camera and the like. Besides, a variety of polishing location measuring means may be used as the location measuring unit 110 of the present invention.

Figure 3:
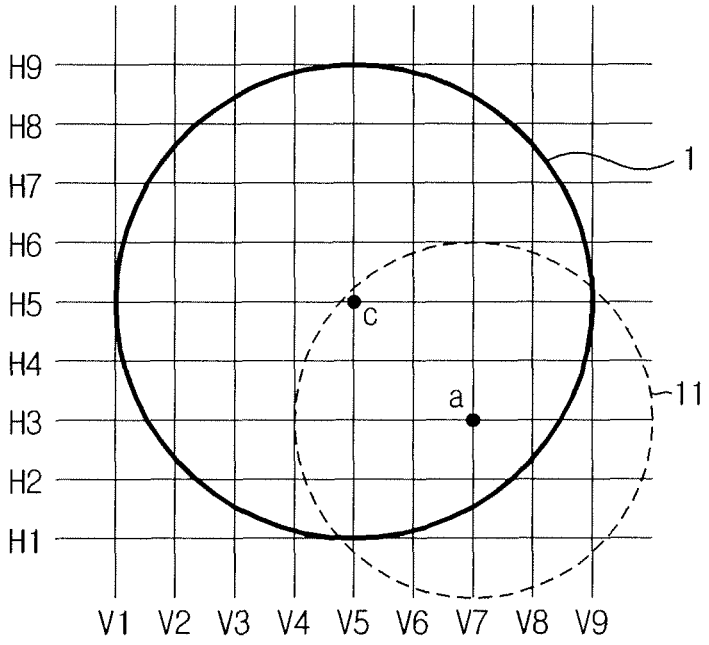
FIG. 3 is a view illustrating a configuration that a location measuring unit measures a location being polished by a polishing machine, viewed from the top of the polishing machine according to an embodiment of the present invention.

FIG. 3 is a view illustrating a configuration that the location measuring unit 110 measures a location being polished by the polishing machine 10, viewed from the top of the polishing machine 10 according to an embodiment of the present invention.

Referring to FIG. 3, the glass plate 1 may be mounted in the polishing machine 10 and may be rotated clockwise or counterclockwise relative to the center (c) of the glass plate 1. In this instance, although FIG. 3 shows the glass plate 1 appears to be circular, the glass plate 1 may be of various shapes including a square shape. Even though the glass plate 1 has any shape, the glass plate 1 may be represented as a circle when the glass plate 1 is rotated for polishing, as shown in FIG. 3. Also, the upper unit 11 having the polishing pad 14 attached thereto may horizontally move on the glass plate 1 which is rotating as described above.

In this instance, to measure a location being polished by the upper unit 11, the location measuring unit 110 may use a coordinate system composed of a plurality of horizontal lines and vertical lines over the entire area of the glass plate 1 being polished. In the embodiment of FIG. 3, a coordinate system for a polishing location includes nine vertical lines V1, V2, . . . , V9 and nine horizontal lines H1, H2, . . . , H9. The location measuring unit 110 may measure a polishing location by reading the coordinates of intersection of the horizontal lines and the vertical lines. For example, as shown in FIG. 3, when the center (a) of the upper unit 11 is located at an intersection of a vertical line V7 and a horizontal line H3, the location measuring unit 110 may measure a polishing location by designating a coordinate of the polishing location as (V7, H3). When a polishing location is represented using a coordinate system, although the center (a) of the upper unit 11 is not located at an intersection of a specific horizontal line and a specific vertical line, the location measuring unit 110 may measure a polishing location by various methods, for example, by designating a coordinate of a polishing location as a closest coordinate.

The upper unit 11 may move on the glass plate 1 along a uniform or ununiform path, and when a polishing location is measured using a coordinate, the location measuring unit 110 has an advantage of measuring a location independent of any movement of the upper unit 11.

Although the embodiment of FIG. 3 shows a polishing location is measured relative to the center (a) of the upper unit 11, the present invention is not limited in this regard. For example, a polishing location may be measured relative to another location of the upper unit 11. Also, the present invention is not limited to a specific number of horizontal or vertical lines and a specific coordinate display method. Accordingly, the location measuring unit 110 may measure and display a location more accurately using a coordinate system including a larger number of horizontal lines and a larger number of vertical lines.

Figure 4:
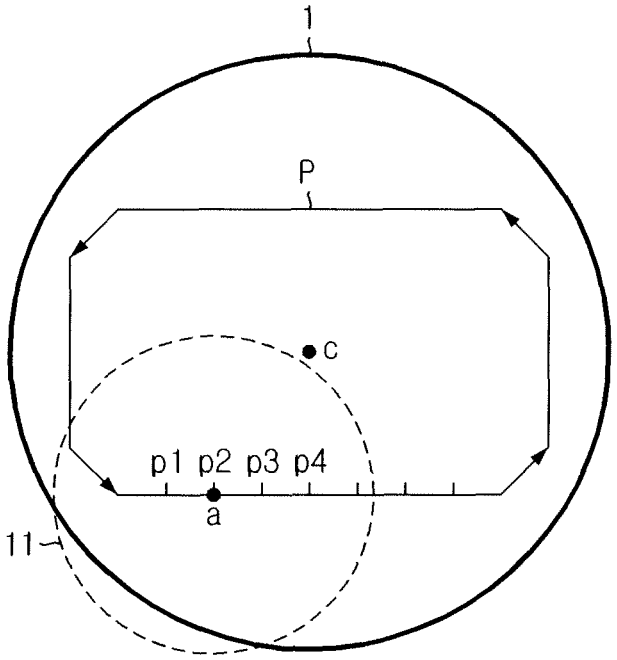
FIG. 4 is a view illustrating a configuration that a location measuring unit measures a location being polished by a polishing machine, viewed from the top of the polishing machine according to another embodiment of the present invention.

FIG. 4 is a view illustrating a configuration that the location measuring unit 110 measures a location being polished by the polishing machine 10, viewed from the top of the polishing machine 10 according to another embodiment of the present invention.

Referring to FIG. 4, the glass plate 1 to be polished may be rotated relative to the center (c) of the glass plate 1, and the upper unit 11 may move along a path P. In this instance, the path P is a path of the center (a) of the upper unit 11. However, this is given by way of illustration only, and it is obvious to an ordinary person in the art that the path P may be a path of another part of the upper unit 11.

When the upper unit 11 moves along the path P, the location measuring unit 110 may measure a polishing location using marks p1, p2, p3, p4, . . . set in advance at a regular interval on the path P, as shown in FIG. 4. For example, when the center (a) of the upper unit 11 is located at a mark p2 as shown in FIG. 4, the location measuring unit 110 may measure and display a polishing location as 'p2'.

Figures 5, 6:
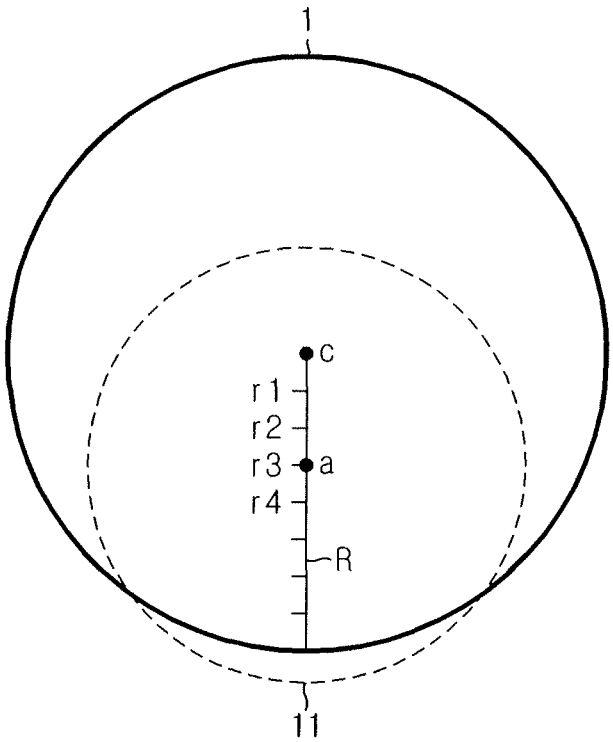
FIG. 5 is a view illustrating a configuration that a location measuring unit measures a location being polished by a polishing machine, viewed from the top of the polishing machine according to still another embodiment of the present invention.
FIG. 6 is a table illustrating a portion of reference values of an electric current flowing into a polishing machine, stored in a memory unit according to an embodiment of the present invention.

FIG. 5 is a view illustrating a configuration that the location measuring unit 110 measures a location being polished by the polishing machine 10, viewed from the top of the polishing machine 10 according to still another embodiment of the present invention.

Referring to FIG. 5, the glass plate 1 to be polished may be rotated relative to the center (c) of the glass plate 1, and the upper unit 11 may move back and fro along a path R, that is, a straight line connecting the center (c) of the glass plate 1 to a certain point at the periphery of the glass plate 1. Although the upper unit 11 moves over a partial area of the glass plate 1, the entire area of the glass plate 1 may be polished because the glass plate 1 rotates. In this instance, the path R may be a path of the center (a) of the upper unit 11, like the path P of FIG. 4, however the present invention is not limited in this regard.

The location measuring unit 11 may measure a polishing location using marks r1, r2, r3, r4, . . . set in advance at a regular interval on the path R, as shown in FIG. 5. For example, when the center (a) of the upper unit 11 is located at a mark r3 as shown in FIG. 5, the location measuring unit 11 may measure and display a polishing location as 'r3'.

FIGS. 3 to 5 are given by way of illustration only, and the present invention may have various modifications and other embodiments. For example, various modifications and changes may be made on a moving range of the upper unit 11, a size ratio of the glass plate 1 and the upper unit 11, the marks, and the like. Also, various methods for measuring a polishing location may be used in the present invention, other than those described in the embodiments of FIGS. 3 to 5.

After the location measuring unit 110 measures a polishing location as described above, the location measuring unit 110 may transmit information about the measured polishing location to the control unit 140.

The current measuring unit 120 may measure an electric current flowing into the polishing machine 10. During polishing of the glass plate 1, when a defect such as an impurity or a scratch exists on the glass plate 1 being polished or when a faulty polishing condition occurs, for example, an excessive or insufficient supply amount of a polishing solution, electric power required for the polishing machine 10 may change. When electric power consumed by the polishing machine 10 changes, an electric current flowing into the polishing machine 10 may change. Accordingly, the current measuring unit 120 may measure an electric current flowing into the polishing machine 10, and may transmit the measured information to the control unit 140.

Preferably, the current measuring unit 120 may measure an electric current flowing into a motor unit 13 of the polishing machine 10. As shown in FIG. 2, the polishing machine 10 may have the motor unit 13 to provide a rotation drive force for rotating the lower unit 12 where the glass plate 1 is mounted. When a defect such as an impurity or a scratch exists on the glass plate 1, or when a faulty polishing condition occurs, for example, an abnormal supply amount of a polishing solution, a change may occur directly to electric power consumed by the motor unit 13 above the other components of the polishing machine 10. Accordingly, the current measuring unit 120 may preferably measure an electric current flowing into the motor unit 13.

The current measuring unit 120 may be provided in various configurations to measure an electric current. For example, the current measuring unit 120 may measure an electric current by measuring the voltage applied to a resistor installed on a current path connected to the polishing machine 10. In particular, the current measuring unit 120 may be installed on a current path 16 connected to the motor unit 13 of the polishing machine 10, and may measure an electric current, as shown in FIG. 2. The present invention is not limited to a specific embodiment of the current measuring unit 120, and a variety of known current measuring units may be used.

The memory unit 130 may store a reference value of an electric current flowing into the polishing machine 10 for each polishing location of the glass plate 1. In this instance, the reference value of the electric current flowing into the polishing machine 10 is a value of an electric current flowing into the polishing machine 10 when it is determined that polishing is performed under normal polishing conditions. For example, the reference value may be a value of an electric current when a defect such as an impurity or a scratch does not exist on the glass plate 1 or when a proper amount of a polishing solution is supplied. The reference value may be obtained by repeatedly testing an electric current flowing into the polishing machine 1 when a normal glass plate 1 free of an impurity or a scratch is polished while a proper amount of a polishing solution is supplied. Also, the reference value may be obtained by various methods.

Preferably, the reference value may be represented as a reference range of an electric current for each polishing location of the glass plate 1. For example, the reference value may be represented as a predetermined reference range between 50 and 100 [A]. This is because there may be an error in a measured value of an electric current depending on circumstances even though the electric current is measured at the same glass plate 1 under the same polishing conditions. Accordingly, it is preferred to set a reference value as a predetermined reference range allowing an error to an extent.

FIG. 6 is a table illustrating a portion of reference values of an electric current flowing into the polishing machine 10, stored in the memory unit 130 according to an embodiment of the present invention.

Referring to FIG. 6, when the location measuring unit 110 represents a polishing location of the glass plate 1 using a coordinate system as shown in FIG. 3, the memory unit 130 may store a table of reference values based on polishing location coordinates. In particular, in this embodiment of FIG. 6, a reference value of an electric current flowing into the polishing machine 10 may be represented as a predetermined reference range.

FIG. 7 is a table illustrating a portion of reference values of an electric current flowing into the polishing machine 10, stored in the memory unit 130 according to another embodiment of the present invention.

Referring to FIG. 7, when the location measuring unit 110 designates a polishing location of the glass plate 1 as an arbitrary point on the path P such as p1, p2, . . . as shown in FIG. 4, the memory unit 130 may store a table of reference values of an electric current for each polishing location. Also, in this embodiment of FIG. 7, a reference value of an electric current flowing into the polishing machine 10 may be represented as a reference range, in the same way as in the embodiment of FIG. 6.

FIG. 8 is a table illustrating a portion of reference values of an electric current flowing into the polishing machine 10, stored in the memory unit 130 according to still another embodiment of the present invention.

Referring to FIG. 8, when the location measuring unit 110 designates a polishing location of the glass plate 1 as an arbitrary point on the path R such as r1, r2, . . . as shown in FIG. 5, the memory unit 130 may store a table of reference values of an electric current for each polishing location. In this instance, the memory unit 130 may also store a reference value of an electric current flowing into the polishing machine 10 as a reference range.

When the current measuring unit 12 measures an electric current flowing into the motor unit 13, the memory unit 130 may store a reference value of the electric current flowing into the motor unit 13.

FIGS. 1 and 2 shows the memory unit 130 appears to exist separately from the other components. However, this does not mean that the memory unit 130 is physically separated from the other components. For example, the memory unit 130 may be formed integrally with the control unit 140.

The control unit 140 may compare a value of an electric current measured by the current measuring unit 120 for each polishing location by the location measuring unit 110, with a reference value of the electric current stored in the memory unit 130 for each polishing location. That is, it is possible to recognize an electric current value measured for each polishing location by receiving polishing location information from the location measuring unit 110 and receiving information of an electric current flowing into the polishing machine 10 from the current measuring unit 120. Then, the control unit 140 may compare the electric current value measured for each polishing location with a corresponding reference value stored in the memory unit 130 for each polishing location. Accordingly, the control unit 140 may determine whether there is an abnormality in a polishing state, based on the comparison result.

As described above, because a reference value stored in the memory unit 130 is a value when a polishing state is normal, when an electric current value measured for each polishing location is equal to a corresponding reference value or falls within a corresponding reference range, the control unit 140 may determine that a polishing state is normal. Conversely, when an electric current value measured for each polishing location is not equal to a corresponding reference value or does not fall within a corresponding reference range, the control unit 140 may determine that a polishing state is faulty.

For example, assuming a reference value stored in the memory unit 130 for each polishing location is as shown in FIG. 6, and a coordinate of a polishing location measured by the location measuring unit 110 is (V7, H3) as shown in FIG. 3. In this case, a reference value corresponding to the polishing location (V7, H3) extracted from the reference value table of FIG. 6 is between 58[A] and 75[A]. Accordingly, when a value of an electric current flowing into the polishing machine 10 measured by the current measuring unit 120 falls within the reference range between 58[A] and 75[A], the control unit 140 may determine a polishing state is normal. However, when the electric current value is smaller than 58[A] or larger than 75[A], the control unit 140 may determine a polishing state as faulty.

In this instance, a polishing state may be determined as faulty by the following conditions, for example, when an impurity or a scratch exists on the glass plate 1, when a supply amount of a polishing solution is larger or smaller than a proper amount, when polishing is poorly performed due to wear of the polishing pad 14 of the polishing machine 10, when a polishing pressure of the polishing machine 10 is not proper, when the glass plate 1 is damaged, and the like.

When the current measuring unit 120 measures a value of an electric current flowing into the motor unit 120, the control unit 140 may determine whether a polishing state is faulty, by comparing a value of the electric current measured by the current measuring unit 120 with a reference value of the electric current flowing into the motor unit 120, stored in the memory unit 130.

Preferably, when the control unit 140 determines that a polishing state of a specific location of the glass plate 1 is faulty, the control unit 140 may provide information of the corresponding location. For example, in the embodiments of FIGS. 3 and 6, when the control unit 140 determines that a polishing state is faulty, the control unit 140 may provide information that a coordinate of the polishing location under the faulty polishing state is (V7, H3), to the polishing machine 10 or a display unit (not shown) such as a monitor, that can be checked by an operator.

Accordingly, the operator may take a proper action against the corresponding location on the glass plate 1. Also, when a fault continuously occurs at a specific location of the glass plate 1, the operator may fundamentally solve the cause of the fault by inspecting and repairing a manufacturing equipment of the glass plate 1 or the polishing machine 10.

In this instance, the control unit 140 may provide the polishing machine 10 with polishing location adjustment information for a polishing location under a faulty polishing state. For example, when a coordinate of a polishing location under a faulty polishing state is (V7, H3) as shown in the embodiment of FIG. 3, the control unit 140 may control the upper unit 11 of the polishing machine 10 to move to the location of (V7, H3) coordinate on the glass plate 1 and to further polish the corresponding location. Accordingly, when a polishing state of a specific location on the glass plate 1 is faulty, because the faulty polishing state may be caused by an impurity or a scratch, the control unit 140 may enable intense and efficient polishing by providing polishing location adjustment information to the polishing machine 10.

Preferably, the control unit 140 may provide polishing solution adjustment information to the polishing machine 10 based on determination on whether a polishing state is faulty.

To improve the polishing efficiency during polishing, the polishing machine 10 may supply a polishing solution to the glass plate 1 through a polishing solution supply unit 15 as shown in FIG. 2. In this instance, when an amount of a polishing solution supplied by the polishing solution supply unit 15 is larger or smaller than a proper amount, the polishing efficiency may not be obtained. Accordingly, the control unit 140 may determine whether an amount of a polishing solution supplied to the glass plate 1 is proper, by comparing a value of an electric current flowing into the polishing machine 10 with a corresponding reference value. Also, when a supply amount of a polishing solution is determined as improper, the control unit 140 may provide the polishing machine 10 with polishing solution adjustment information to control the polishing machine 10 to suitably adjust the supply amount of the polishing solution.

In this instance, when a value of an electric current measured for each polishing location is smaller than a reference value of the electric current for each polishing location, the control unit 140 may determine a polishing state as faulty and provide the polishing machine 10 with polishing solution adjustment information to control the polishing machine 10 to reduce a supply amount of a polishing solution. When the supply amount of the polishing solution is larger than a proper amount, the polishing pad 14 of the upper unit 11 may excessively slide on the glass plate 1 and electric power required for the polishing machine 10 may be reduced, and consequently, a value of an electric current flowing into the polishing machine 10 may be smaller than that of a normal polishing state. In this case, the polishing efficiency by the polishing solution may be obtained by reducing the supply amount of the polishing solution to prevent the polishing pad 14 from excessively sliding on the glass plate 1.

Also, when a value of an electric current measured for each polishing location is larger than a reference value of the electric current for each polishing location, the control unit 140 may provide the polishing machine 10 with polishing solution adjustment information to control the polishing machine 10 to increase a supply amount of a polishing solution. When the supply amount of the polishing solution is smaller than a proper amount, friction between the polishing pad 14 of the upper unit 11 and the glass plate 1 may increase and electric power required for the polishing machine 10 may be increased, and consequently, a value of an electric current flowing into the polishing machine 10 may be larger than that of a normal polishing state. In this case, the polishing efficiency by the polishing solution may be obtained by increasing the supply amount of the polishing solution to a proper amount.

For example, assuming a reference value of an electric current stored in the memory unit 130 for each polishing location is as shown in FIG. 7 and a polishing location of the glass plate 1 measured by the location measuring unit 110 is p2 as shown in FIG. 4. A reference range of an electric current corresponding to the polishing location p2 is between 60[A] and 72[A], as shown in FIG. 7. When the electric current value measured by the current measuring unit 120 at the polishing location p2, where the center (a) of the upper unit 11 is located, is smaller than the reference range, that is, smaller than 60[A], the control unit 140 may provide the polishing machine 10 with polishing solution adjustment information to control the polishing machine 10 to reduce a supply amount of a polishing solution. Conversely, when the electric current value measured by the current measuring unit 120 is larger than 72[A], the control unit 140 may provide the polishing machine 10 with polishing solution adjustment information to control the polishing machine 10 to increase a supply amount of a polishing solution.

Also, the control unit 140 may preferably provide polishing time adjustment information to the polishing machine 10 based on determination on whether a polishing state is faulty.

For example, when a measured value of an electric current is larger than a corresponding reference value after the lapse of a preset polishing time, the control unit 140 may determine a polishing state as faulty. In this case, the control unit 140 may control the polishing machine 10 to increase the polishing time for further polishing. Conversely, when a measured value of an electric current is equal to a corresponding reference value or falls within a corresponding reference range before a preset polishing time is reached, the control unit 140 may determine a polishing state as normal. In this case, the control unit 140 may control the polishing machine 10 to terminate polishing or reduce the polishing time.

More specifically, assuming a reference value of an electric current stored in the memory unit 130 for each polishing location is as shown in FIG. 8 and a polishing location of the glass plate 1 measured by the location measuring unit 110 is r3 as shown in FIG. 5. A reference range of an electric current corresponding to the polishing location r3 is between 56[A] and 70[A], as shown in FIG. 8. When the electric current value measured at the polishing location r3 after the lapse of a preset polishing time is beyond the reference range between 56[A] and 70[A], the control unit 140 may determine a polishing state as faulty. Also, the control unit 140 may provide the polishing machine 10 with polishing time adjustment information to control the polishing machine 10 to increase the polishing time. Conversely, when the electric current value measured at the polishing location r3 before a preset polishing time is reached falls within the reference range between 56[A] and 70[A], the control unit 140 may determine a polishing state as normal and may provide the polishing machine 10 with polishing time adjustment information to control the polishing machine 10 to reduce the polishing time.

According to this embodiment, it may flexibly adjust a glass plate polishing time for each glass plate depending on the polishing state, thereby saving the time and cost spent in polishing the glass plate 1 while improving productivity of products using the glass plate 1.

Also, the control unit 140 may preferably provide polishing pad replacement information based on determination on whether a polishing state is faulty. For example, when a measured value of an electric current flowing into the polishing machine 10 is smaller than a corresponding reference value stored in the memory unit 130, the control unit 140 may provide the polishing machine 10 or a separate display device such as a monitor with information that the polishing pad 14 mounted in the polishing machine 10 needs to be replaced, so that an operator may check the information through the polishing machine 10 or the display device. When the polishing pad 14 is worn down, friction between the polishing pad 14 and the glass plate 1 may be reduced, and consequently, electric power consumed by the polishing machine 10 may be reduced.

Also, the control unit 140 may preferably provide the polishing machine 10 with polishing pressure adjustment information based on determination on whether a polishing state is faulty. For example, when a measured value of an electric current flowing into the polishing machine 10 is smaller than a corresponding reference value stored in the memory unit 130, the control unit 140 may determine that a polishing pressure is lower than a reference pressure, and may provide the polishing machine 10 with polishing pressure adjustment information to control the polishing machine 10 to increase the polishing pressure. In this instance, the polishing machine 10 may increase the polishing pressure by lifting the upper unit 11 down to an extent. Conversely, when a measured value of an electric current flowing into the polishing machine 10 is larger than a corresponding reference value stored in the memory unit 130, the control unit 140 may determine that a polishing pressure is higher than a reference pressure, and may provide the polishing machine 10 with polishing pressure adjustment information to control the polishing machine 10 to reduce the polishing pressure.

Also, the control unit 140 may preferably provide information about whether the glass plate 1 is damaged, based on determination on whether the polishing state is faulty. For example, when a measured value of an electric current flowing into the polishing machine 10 is larger than a corresponding reference value, the control unit 140 may determine that the glass plate 1 is damaged, and may provide the polishing machine 10 or a separate display device with information about the damage of the glass plate 1. When the glass plate 1 is damaged, the damaged part may cause an increase in friction between the glass plate 1 and the polishing pad 14, and consequently an increase in electric power consumed by the polishing machine 10.

The polishing machine 10 of the present invention may include the apparatus 100 for monitoring a glass plate polishing state as described above.

Figure 9:
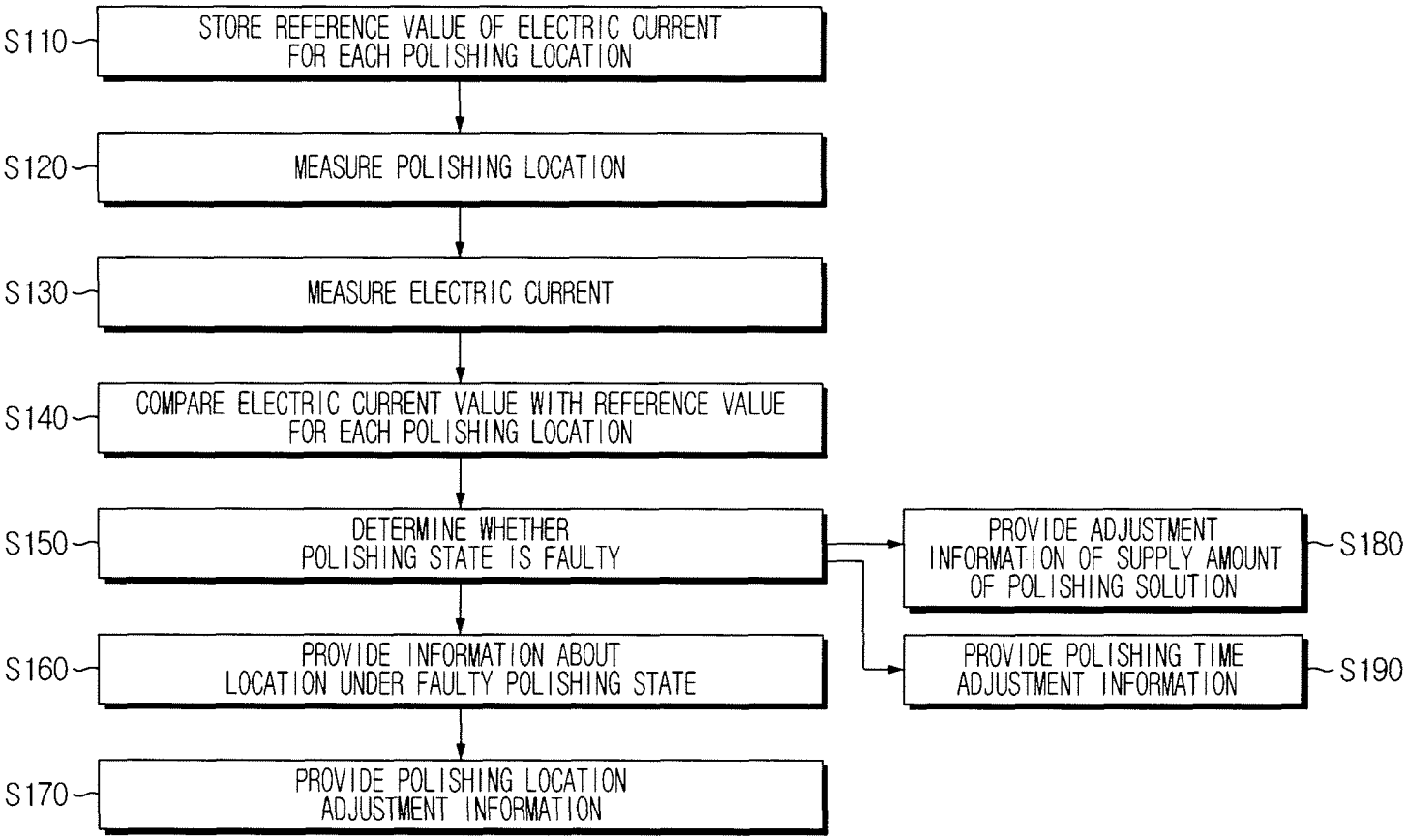
FIG. 9 is a schematic flowchart illustrating a method for monitoring a glass plate polishing state according to an embodiment of the present invention.

FIG. 9 is a schematic flowchart illustrating a method for monitoring a glass plate polishing state according to an embodiment of the present invention.

Referring to FIG. 9, the method for monitoring a glass plate polishing state according to the present invention may include a step (S110) of storing a reference value of an electric current flowing into the polishing machine for each polishing location of the glass plate, a step (S120) of measuring a location being polished by the polishing machine, a step (S130) of measuring an electric current flowing into the polishing machine at the measured location, a step (S140) of comparing a measured value of the electric current for each polishing location with a corresponding reference value of the electric current for each polishing location, and a step (S150) of determining whether a polishing state of the corresponding glass plate is faulty.

Preferably, when the polishing machine includes a motor unit to provide a rotation drive force for polishing, the electric current flowing into the polishing machine may be an electric current flowing into the motor unit.

Also, the reference value may be preferably represented as a reference range of an electric current for each polishing location of the glass plate.

Also, when the polishing state is determined as faulty in the step S150, the method may further include a step (S160) of providing information about a polishing location under the faulty polishing state, after the step S150. In this instance, the method may further include a step (S170) of providing polishing location adjustment information for the polishing location under the faulty polishing state, after the step S160.

Also, the method may further include a step (S180) of providing the polishing machine with polishing solution adjustment information based on the determination result, after the step (S150). In this instance, when a measured value of an electric current for each polishing location is smaller than a corresponding reference value of the electric current for each polishing location, the step (S180) of providing the information to the polishing machine may be performed to control the polishing machine to reduce a supply amount of a polishing solution. Conversely, when a measured value of an electric current for each polishing location is larger than a corresponding reference value of the electric current for each polishing location, the step (S180) of providing the information to the polishing machine may be performed to control the polishing machine to increase a supply amount of a polishing solution.

Also, the method may further include a step (S190) of providing the polishing machine with polishing time adjustment information based on the determination result, after the step (S150).

Although FIG. 9 shows the steps (S180) and (S190) are performed independently of the steps (S160) and (S170), this is given by way of illustration only. For example, the step (S180) or (S190) may be performed after the steps (S160) and (S170).

Also, although not shown in drawings, the method may further include, after the step (S150), a step of providing the polishing machine with at least one of polishing pad replacement information, polishing pressure adjustment information, and information about whether the glass plate is damaged, based on the determination result.

Many modifications and other embodiments of the invention will come to mind to one skilled in the art to which this invention pertains having the benefit of the teachings presented in the foregoing description. Therefore, it should be understood that the invention is not to be limited to the specific embodiments disclosed and that modifications and other embodiments are intended to be included within the scope of the appended claims.

Although the term "unit" is used herein, it is obvious to an ordinary person skilled in the art that it refers to a logic unit, but does not necessarily refer to a component that is physically separated.

What is claimed is:

1. An apparatus for monitoring a glass plate polishing state, which monitors a polishing state during polishing of a glass plate using a polishing machine, the apparatus comprising:

a location measuring unit for measuring multiple locations on the glass plate being polished by the polishing machine;

a current measuring unit for measuring an electric current flowing into the polishing machine;

a memory unit for storing reference values of the electric current flowing into the polishing machine for each polishing location of the glass plate; and a control unit for determining whether a polishing state is faulty, by comparing a value of the electric current measured by the current measuring unit for each polishing location of the glass plate measured by the location measuring unit with a corresponding reference value of the electric current stored in the memory unit for each polishing location of the glass plate.

2. The apparatus for monitoring a glass plate polishing state according to claim 1, wherein the electric current flowing into the polishing machine is an electric current flowing into a motor unit when the polishing machine includes the motor unit to provide a rotation drive force for polishing.

3. The apparatus for monitoring a glass plate polishing state according to claim 1, wherein the reference value is represented as a reference range of the electric current for each polishing location of the glass plate.

4. The apparatus for monitoring a glass plate polishing state according to claim 1, wherein when the control unit determines that a glass plate polishing state at a specific location is faulty, the control unit provides information about the corresponding location.

5. The apparatus for monitoring a glass plate polishing state according to claim 4, wherein the control unit provides the polishing machine with polishing location adjustment information for the location under the polishing state determined as faulty.

6. The apparatus for monitoring a glass plate polishing state according to claim 1, wherein the control unit provides the polishing machine with adjustment information of a supply amount of a polishing solution based on the determination on whether the polishing state is faulty.

7. The apparatus for monitoring a glass plate polishing state according to claim 6, wherein the control unit provides the information to control the polishing machine to reduce the supply amount of the polishing solution, when the measured value of the electric current for each polishing location is smaller than the corresponding reference value of the electric current for each polishing location.

8. The apparatus for monitoring a glass plate polishing state according to claim 6, wherein the control unit provides the information to control the polishing machine to increase the supply amount of the polishing solution, when the measured value of the electric current for each polishing location is larger than the corresponding reference value of the electric current for each polishing location.

9. The apparatus for monitoring a glass plate polishing state according to claim 1, wherein the control unit provides the polishing machine with polishing time adjustment information based on the determination on whether the polishing state is faulty.

10. The apparatus for monitoring a glass plate polishing state according to claim 1, wherein the control unit provides polishing pad replacement information based on determination on whether the polishing state is faulty.

11. The apparatus for monitoring a glass plate polishing state according to claim 1, wherein the control unit provides the polishing machine with polishing pressure adjustment information based on the determination on whether the polishing state is faulty.

12. The apparatus for monitoring a glass plate polishing state according to claim 1, wherein the control unit provides the polishing machine with information about whether the glass plate is damaged, based on determination on whether the polishing state is faulty.

13. A polishing machine for a glass plate, comprising the apparatus for monitoring a glass plate polishing state defined in claim 1.

14. A method for monitoring a glass plate polishing state, which monitors a polishing state during polishing of a glass plate using a polishing machine, the method comprising:

(S1) storing reference values of an electric current flowing into the polishing machine for each polishing location of the glass plate;

(S2) measuring multiple locations on the glass plate being polished by the polishing machine;

(S3) measuring the electric current flowing into the polishing machine; and (S4) determining whether a polishing state is faulty, by comparing a measured value of the electric current for each polishing location of the glass plate with a corresponding reference value of the electric current for each polishing location of the glass plate.

15. The method for monitoring a glass plate polishing state according to claim 14, wherein the electric current flowing into the polishing machine is an electric current flowing into a motor unit when the polishing machine includes the motor unit to provide a rotation drive force for polishing.

16. The method for monitoring a glass plate polishing state according to claim 14, wherein the reference value is represented as a reference range of the electric current for each polishing location of the glass plate.

17. The method for monitoring a glass plate polishing state according to claim 14, further comprising:

when the polishing state at a specific location is determined as faulty in the step (S4), (S5) providing information about the location under the polishing state determined as faulty.

18. The method for monitoring a glass plate polishing state according to claim 17, further comprising:

after the step (S4), (S6) providing the polishing machine with polishing location adjustment information for the location under the polishing state determined as faulty.

19. The method for monitoring a glass plate polishing state according to claim 14, further comprising:

after the step (S4), (S7) providing the polishing machine with adjustment information of a supply amount of a polishing solution based on the determination on whether the polishing state is faulty.

20. The method for monitoring a glass plate polishing state according to claim 19, wherein the step (S7) comprises providing the information to control the polishing machine to reduce the supply amount of the polishing solution, when the measured value of the electric current for each polishing location is smaller than the corresponding reference value of the electric current for each polishing location.

21. The method for monitoring a glass plate polishing state according to claim 19, wherein the step (S7) comprises providing the information to control the polishing machine to increase the supply amount of the polishing solution, when the measured value of the electric current for each polishing location is larger than the corresponding reference value of the electric current for each polishing location.

22. The method for monitoring a glass plate polishing state according to claim 14, further comprising:

after the step (S4), (S8) providing the polishing machine with polishing time adjustment information based on the determination on whether the polishing state is faulty.

23. The method for monitoring a glass plate polishing state according to claim 14, further comprising:

after the step (S4), provides polishing pad replacement information based on the determination on whether the polishing state is faulty.

24. The method for monitoring a glass plate polishing state according to claim 14, further comprising:

after the step (S4), providing the polishing machine with polishing pressure adjustment information based on the determination on whether the polishing state is faulty.

25. The method for monitoring a glass plate polishing state according to claim 14, further comprising:

after the step (S4), providing the polishing machine with information about whether the glass plate is damaged, based on the determination on whether the polishing state is faulty.

* * * * *